US006830151B2

(12) United States Patent
Spencer et al.

(10) Patent No.: US 6,830,151 B2
(45) **Date of Patent: *Dec. 14, 2004**

(54) CONTAINER FOR DISPENSING CONTROLLED AMOUNTS OF PAPER PRODUCTS

(75) Inventors: Jan Byron Charles Spencer, Roswell, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/205,880

(22) Filed: Jul. 26, 2002

(65) Prior Publication Data

US 2002/0179630 A1 Dec. 5, 2002

Related U.S. Application Data

(63) Continuation of application No. 09/206,956, filed on Dec. 8, 1998, now abandoned.

(51) Int. Cl.[7] ..... B65D 21/00; A47K 10/24

(52) U.S. Cl. ..... 206/499; 206/497; 206/409; 206/738; 221/45; 221/197; 221/46; 221/63

(58) Field of Search ..... 206/249, 449, 206/556, 494, 499, 201, 804, 738, 748, 772, 409; 221/33–34, 44–48, 49, 52–53, 55, 61–63, 303, 305, 309–310

(56) References Cited

U.S. PATENT DOCUMENTS 371,473 A 10/1887 Onderdonk
813,594 A 2/1906 Sexton (List continued on next page.)

FOREIGN PATENT DOCUMENTS

EP 331027 9/1989
EP 372781 6/1990

(List continued on next page.)

OTHER PUBLICATIONS

General Catalogue '93 (in both Spanish and English), Lineacqualba.
Marplas Catalog (in both Spanish and English), Lineacqualba.

(List continued on next page.)

*Primary Examiner*—Jila M. Mohandesi
(74) *Attorney, Agent, or Firm*—Dority & Manning, P.A.

(57) ABSTRACT

A container is disclosed for dispensing a controlled amount of paper products. The container includes a housing including a first end wall and a plurality of exterior walls defining an interior surface and an interior area within the interior surface for receiving the plurality of paper products. A first, second and third of the exterior walls intersect a first end wall to form a portion of the interior surface and define an open face of the container. The exterior walls further include a fourth wall extending between the second and third walls adjacent the first end wall and the open face. The container defines a dispensing throat extending through the fourth wall adjacent the slit in the cartridge. The first end wall may be slanted relative to the second and third walls. A cartridge is inserted into the interior area of the housing through the open face of the container. The cartridge contains the plurality of paper products to be dispensed. The cartridge includes cartridge walls including side walls, a front wall disposed in the open face of the container, and a bottom wall which may be slanted relative to the side walls so as to be matingly disposed against the first end wall of the container when the cartridge is disposed within the housing. A slit is defined through the front wall for dispensing the plurality of paper products though the dispensing throat. Protrusions may extend from the housing though openings in the cartridge to contact the paper products.

37 Claims, 11 Drawing Sheets

U.S. PATENT DOCUMENTS

| | | | | |
|---|---|---|---|---|
| 1,170,380 | A | | 2/1916 | Winter |
| 1,236,055 | A | | 8/1917 | Cohn |
| 1,579,429 | A | | 4/1926 | Arms et al. |
| 1,605,231 | A | | 11/1926 | Hoberg |
| 1,665,057 | A | | 4/1928 | Genest |
| 1,709,214 | A | | 4/1929 | Griffith |
| D92,455 | S | | 6/1934 | Coles |
| 1,974,926 | A | | 9/1934 | Marsh |
| 1,989,381 | A | | 1/1935 | Samson |
| 2,033,582 | A | | 3/1936 | Materno |
| 2,143,614 | A | | 1/1939 | Winter et al. |
| 2,195,437 | A | | 4/1940 | West |
| 2,323,395 | A | | 7/1943 | Harwood |
| 2,730,267 | A | | 1/1956 | Marcalus |
| 2,816,376 | A | | 12/1957 | Hirvonen |
| 2,858,016 | A | | 10/1958 | Marano |
| 2,858,045 | A | | 10/1958 | Loeb |
| 3,028,047 | A | | 4/1962 | Tuft |
| 3,161,336 | A | | 12/1964 | Loescher |
| 3,164,298 | A | | 1/1965 | Repko |
| 3,203,586 | A | | 8/1965 | Downham |
| 3,258,114 | A | | 6/1966 | King |
| 3,272,385 | A | | 9/1966 | Watkins |
| 3,332,594 | A | | 7/1967 | DeCapua |
| 3,343,716 | A | | 9/1967 | Peebles |
| 3,349,959 | A | | 10/1967 | Watkins |
| 3,724,716 | A | | 4/1973 | Baraconi et al. |
| 3,747,802 | A | | 7/1973 | Uroshevich |
| 3,754,681 | A | | 8/1973 | Slye et al. |
| 3,843,085 | A | | 10/1974 | Castro |
| 4,004,691 | A | | 1/1977 | Wihksne |
| 4,411,374 | A | | 10/1983 | Hotchkiss |
| D275,345 | S | | 9/1984 | Hall |
| 4,469,243 | A | | 9/1984 | Ito et al. |
| 4,491,242 | A | | 1/1985 | Trinidad |
| 4,566,607 | A | | 1/1986 | Smith |
| 4,623,074 | A | | 11/1986 | Dearwester |
| 4,678,099 | A | | 7/1987 | Matsui |
| 4,679,703 | A | | 7/1987 | DeLuca |
| 4,706,844 | A | | 11/1987 | Omdoll et al. |
| 4,768,679 | A | | 9/1988 | Matsui |
| 4,805,800 | A | | 2/1989 | Nocek et al. |
| 4,838,454 | A | | 6/1989 | Salzmann et al. |
| D302,949 | S | | 8/1989 | Eisendrath |
| 4,877,154 | A | | 10/1989 | Matsui |
| 4,938,382 | A | | 7/1990 | Frazier et al. |
| 5,002,200 | A | | 3/1991 | Hunt |
| 5,020,670 | A | | 6/1991 | Bedford |
| 5,065,895 | A | | 11/1991 | DeLuca et al. |
| 5,090,592 | A | | 2/1992 | Petterson et al. |
| 5,100,020 | A | | 3/1992 | Petterson et al. |
| 5,102,007 | A | | 4/1992 | Petterson et al. |
| 5,143,252 | A | | 9/1992 | Shi |
| 5,219,092 | A | | 6/1993 | Morand |
| D347,344 | S | | 5/1994 | Schumaker |
| 5,310,057 | A | | 5/1994 | Caldwell et al. |
| 5,332,118 | A | | 7/1994 | Muckenfuhs |
| 5,346,064 | A | | 9/1994 | Rizzuto |
| 5,356,032 | A | | 10/1994 | Rhodes |
| 5,460,322 | A | | 10/1995 | Carlson et al. |
| 5,462,197 | A | | 10/1995 | Pound |
| D366,583 | S | | 1/1996 | Scaife |
| 5,509,571 | A | | 4/1996 | Weber |
| 5,520,308 | A | | 5/1996 | Berg, Jr. et al. |
| 5,590,813 | A | | 1/1997 | Abramczyk |
| 5,622,281 | A | | 4/1997 | Annand |
| 5,632,409 | A | | 5/1997 | Raghunanan |
| 5,642,836 | A | | 7/1997 | Merriweather, Jr. |
| 5,690,230 | A | | 11/1997 | Griffith |
| 5,836,478 | A | | 11/1998 | Weiss |
| 5,853,845 | A | | 12/1998 | McConnell et al. |
| 5,931,339 | A | | 8/1999 | Dodge et al. |
| D414,085 | S | | 9/1999 | Campbell |
| 5,950,863 | A | | 9/1999 | Schutz et al. |
| 6,241,118 | B1 | * | 6/2001 | Tramontina ..... 221/45 |
| 6,296,331 | B1 | | 10/2001 | Tramontina |
| 6,354,462 | B1 | | 3/2002 | Conran et al. |
| 6,378,726 | B1 | | 4/2002 | Chan et al. |
| 6,415,949 | B1 | * | 7/2002 | Tramontina ..... 221/45 |
| 6,419,113 | B1 | * | 7/2002 | Tramontina ..... 221/45 |
| 6,422,416 | B1 | * | 7/2002 | Tramontina ..... 221/45 |

FOREIGN PATENT DOCUMENTS

| | | |
|---|---|---|
| EP | 419063 | 3/1991 |
| EP | 811348 | 12/1997 |
| FR | 336986 | 11/1903 |
| FR | 1537127 | 7/1968 |
| FR | 2362610 | 3/1978 |
| GB | 423276 | 1/1935 |
| GB | 1112680 | 5/1968 |
| JP | 187873 | 8/1991 |
| SE | 149028 | 11/1952 |
| TW | 195789 | 7/1981 |
| WO | WO 9709918 | 3/1997 |
| WO | WO 9711630 | 4/1997 |
| WO | WO 9722528 | 6/1997 |
| WO | WO 9822009 | 5/1998 |
| WO | WO 9840002 | 9/1998 |
| WO | WO 9826702 | 12/1998 |
| WO | WO 9930601 | 6/1999 |

OTHER PUBLICATIONS

CEMASA Commercial Catalog (Italian), Jun. 30, 1999.
English Translation of CEMASA Commercial Catalog, Jun. 30, 1999.
Abstract for France Patent No. 2362610.
Abstract for Japan Patent No. 187873.
PCT Written Opinion Int'l. Appl. No. PCT/US/98/26702, Oct. 25, 1999.
PCT Int'l Search Report Int'l. Appl. No. PCT/US/99/29137, Mar. 28, 2000.

* cited by examiner

CONTAINER FOR DISPENSING CONTROLLED AMOUNTS OF PAPER PRODUCTS

RELATED APPLICATIONS

The present application is a continuation of U.S. Pat. No. 09/206,956, filed Dec. 8, 1998, now abandoned incorporated by reference in its entirety herein.

BACKGROUND OF THE INVENTION

This invention relates generally to the field of dispensing devices and systems. More particularly, this invention relates to the field of devices and systems for dispensing paper products such as napkins, towels, bath tissue, etc.

Various types of dispensers for paper products have been developed to provide ready availability of the paper products to users. Such dispensers are often provided in public places such as restaurants or ret rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

Unfortunately, large dispensers are subject to a number of drawbacks. First, it is difficult to uniformly dispense individual paper products or a controlled amount of paper products from a large dispenser without dispensing more paper products than necessary to a user. Thus, too many paper products are removed by a user, and some of the paper products are wasted. If too many paper products are removed from a dispenser, the benefits provided by a larger dispenser are eliminated as the dispenser is emptied more rapidly.

Second, many dispensers are difficult to load, and that difficulty can increase with the size of the dispenser. If paper products are not properly loaded into the dispenser, the paper products may jam as they are removed thereby preventing further removal of paper products by users. Also, a person refilling a large dispenser is more likely, due to the larger number of paper products involved, to drop some of the paper products onto a floor. Any dropped paper products are then unsanitary and must be discarded, thereby creating more waste and again defeating the benefits of the larger dispenser.

A further drawback of many currently available dispensers regardless of size is that it is impossible to determine without opening the dispenser how many paper products remain within the dispenser. Thus, a person must either periodically check the dispenser to determine how many paper products remain or be vigilant to refill the dispenser as soon as it is empty. Both alternatives involve much personal attention and, especially during peak usage, can lead to empty dispensers if dispensers are not vigilantly monitored.

SUMMARY OF THE INVENTION

According to certain aspects of the invention, a container is disclosed for dispensing a controlled amount of paper products. The container comprises a housing including a first end wall and a plurality of exterior walls defining an interior surface and an interior area within the interior surface for receiving the plurality of paper products. A first, second and third of the exterior walls intersect a first end wall to form a portion of the interior surface and define an open face of the container. Protrusions extend from the interior surface into the interior area for contacting the paper products. A cartridge is inserted into the interior area of the housing, the cartridge containing the plurality of paper products to be dispensed. The cartridge includes cartridge walls including a front wall disposed in the open face of the container when the cartridge is disposed within the housing. Openings are defined in the cartridge walls wherein at least one of the protrusions extends through at least one of the openings to contact the plurality of paper products. A slit is defined through the front wall for dispensing the plurality of paper products.

The container may also include cartridge retaining structure for retaining the cartridge in the interior area of the housing. The cartridge retaining structure may be configured on the first end wall or opposing second and third exterior walls.

The housing may include at least one element selected from blocks, chucks, stops, wires, braces, brackets, bars, pins, clips, hooks, clamps, adhesive materials, and interlocking container and cartridge geometries. The element retains the cartridge within the housing.

The container may include a fourth wall extending between the second and third walls adjacent the first end wall and the open face, and the container may define a dispensing throat extending through the fourth wall adjacent the slit in the cartridge. The dispensing throat may include a finger slot in the fourth wall and/or a thumb slot in the first end wall. A staging area may be provided proximate the first end wall for spacing and slowing the paper products.

The cartridge walls may include a bottom wall, the slit being defined by the front wall and the bottom wall of the cartridge. The cartridge may be configured so the slit is sized to have a horizontal dimension about the same as or slightly greater than the width of the paper products within the cartridge and a vertical dimension that is large enough to permit the passage of a limited number of paper products. Also, the vertical dimension of the slit may be between about 2 and about 10 times the thickness of an individual folded paper product. The slit may include a finger slot in the front wall and/or a thumb slot in the bottom wall.

The housing may include a bar connecting the second and third exterior walls for retaining the cartridge within the housing, and the bar may define a dispensing throat having a finger slot.

Structure may be provided for urging the paper products within the interior area in a dispensing direction toward the first end wall to a dispensing position near the slit. If so, the protrusions extending from the portion of the interior surface on the exterior walls may oppose the structure for urging.

The first end wall may be slanted relative to the second and third walls, and the cartridge may include a bottom wall configured to conform to the slanted first end wall of the housing. The first end wall may slant with upward or downward in the direction of the open face of the container.

The protrusions may include rib members extending from the first end wall of the housing and the cartridge may include openings at locations corresponding to the rib members. The protrusions may also include bumpers extending from the second and third walls, and the cartridge may include openings at locations corresponding to the bumpers.

According to certain other aspects of the invention, a container is disclosed for dispensing a controlled amount of paper products. The container includes a housing including a first end wall and a plurality of exterior walls defining an interior surface and an interior area within the interior surface for receiving the plurality of paper products. A first, second and third of the exterior walls intersect a first end wall to form a portion of the interior surface and define an open face of the container. The exterior walls further include a fourth wall extending between the second and third walls adjacent the first end wall and the open face. The container defines a dispensing throat extending through the fourth wall, the first end wall being slanted relative to the second and third walls. A protrusion extends from the interior surface into the interior area for contacting the paper products, and a cartridge is inserted into the interior area of the housing. The cartridge contains the plurality of paper products to be dispensed. The cartridge includes cartridge walls including a front wall disposed in the open face of the container when the cartridge is disposed within the housing, openings being defined in the cartridge walls wherein at least one of the protrusions extends through at least one of the openings to contact the plurality of paper products. A slit is defined through the front wall adjacent the dispensing throat in the housing for dispensing the plurality of paper products through the dispensing throat.

According to certain other aspects of the invention, a container is disclosed for dispensing a controlled amount of paper products. The container includes a housing including a first end wall and a plurality of exterior walls defining an interior surface and an interior area within the interior surface for receiving the plurality of paper products. A first, second and third of the exterior walls intersect a first end wall to form a portion of the interior surface and define an open face of the container. The exterior walls further include a fourth wall extending between the second and third walls adjacent the first end wall and the open face. The container defines a dispensing throat extending through the fourth wall, the first end wall being slanted relative to the second and third walls. A cartridge is inserted into the interior area of the housing through the open face of the container. The cartridge contains the plurality of paper products to be dispensed, the cartridge including cartridge walls including side walls. A front wall is disposed in the open face of the container, and a bottom wall is slanted relative to the side walls so as to be matingly disposed against the first end wall of the container when the cartridge is disposed within the housing. A slit is defined through the front wall adjacent the dispensing throat in the housing for dispensing the plurality of paper products though the dispensing throat.

DETAILED DESCRIPTION

Figure 1:
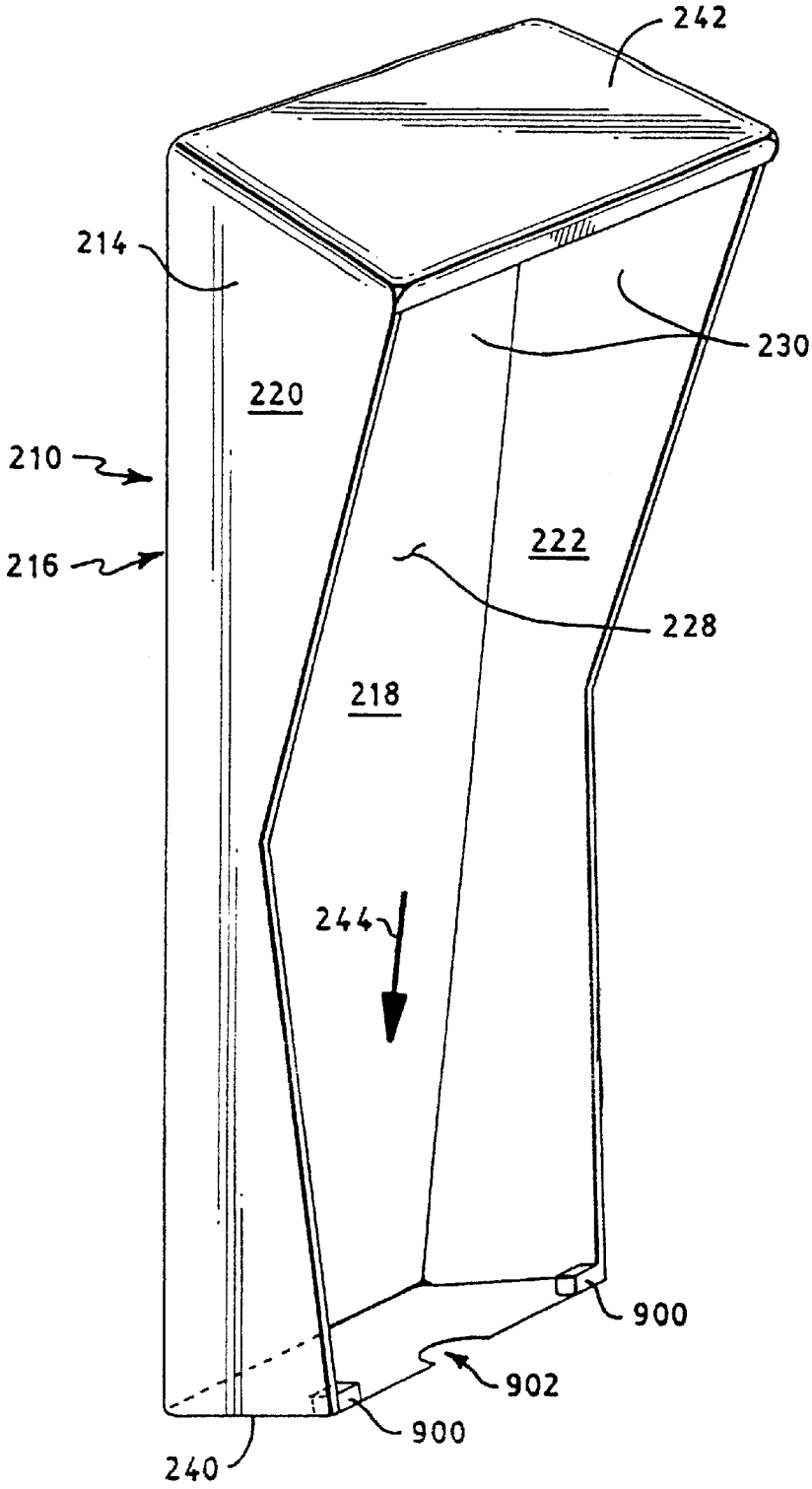
FIG. 1 is a perspective view of a housing of an exemplary container for dispensing paper products from a cartridge holding a plurality of paper products.
Figure 2:
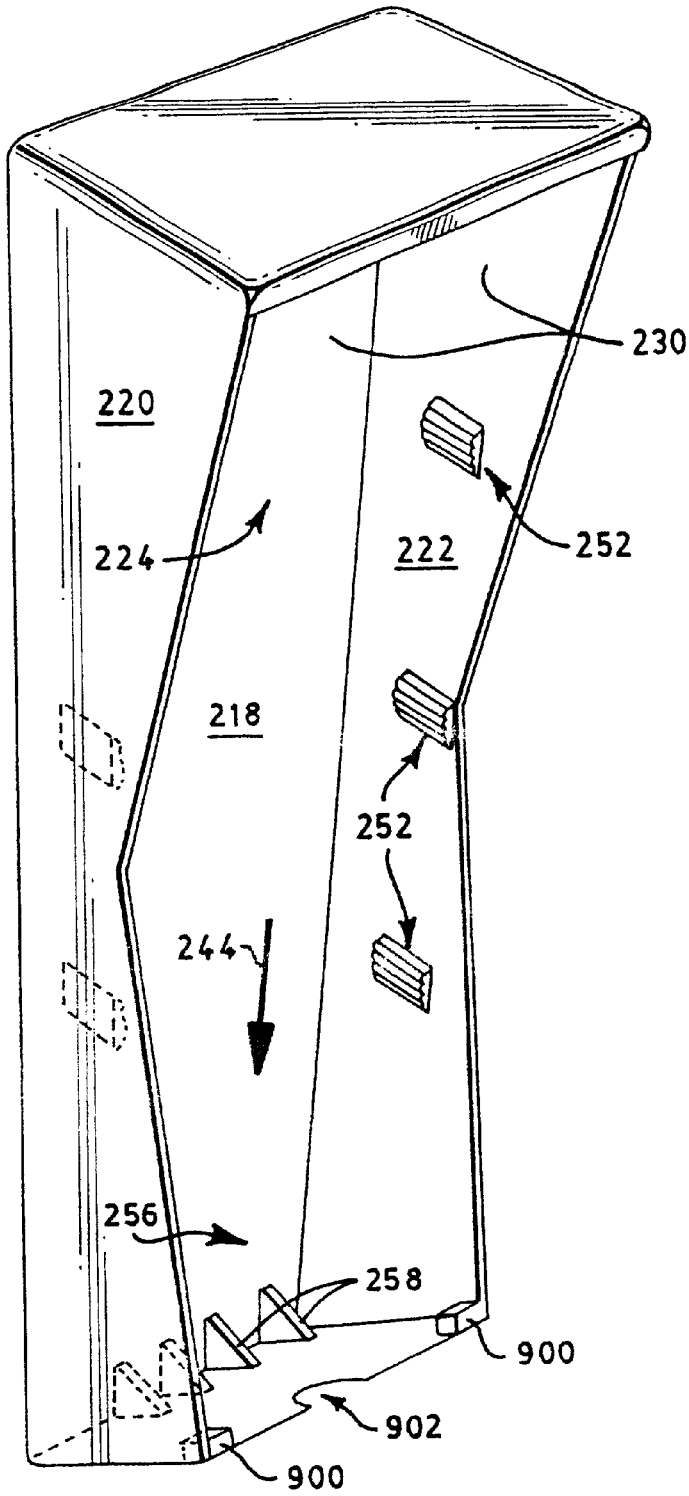
FIG. 2 is another exemplary container for dispensing paper products from a cartridge holding a plurality of paper products.

The present invention relates to a container 210 for holding paper products 212 to be dispensed to a user. As shown in FIGS. 1 and 2, container 210 includes a housing 214 defined by exterior walls 216, including first wall 218, second wall 220, and a third wall 222. Exterior walls 216 define an interior surface 230, within which is disposed an interior area 228. The housing 214 further includes a first end wall 240 and may also include a second end wall 242. Paper products 212 are dispensed in a dispensing direction 244. Housing 214 includes plurality of protrusions 250, including curved bumpers 252 having ridges 254 and rib members 258 disposed in a staging area 256.

Another feature which may be seen in FIGS. 1 and 2 is the fully open face of the dispensers which includes one or more cartridge retaining means 900 which may be affixed to the end wall 240 and/or exterior walls 220 and 230.

The cartridge retaining means 900 may be small blocks, chucks, stops, wires, braces, brackets, pins, clips or the like as well as combinations thereof. Alternatively and/or additionally, it is contemplated that other devices such as hooks, clamps or the like, adhesive materials, or interlocking or interacting container and cartridge geometries may be used as cartridge retaining means. The position of these means may be in the interior of the container and the illustration of the means at the exterior is not intended to be limiting.

A thumb notch 902 may be located in the first end wall 240 along the dispensing direction 244. The thumb notch may be configured in any shape or size that is appropriate for the dimensions of the dispenser and the product to be dispensed. Desirably, the thumb notch will have dimensions that are compatible with the dimensions of any finger or thumb notches in any cartridges containing paper products used with the container.

Figure 3:
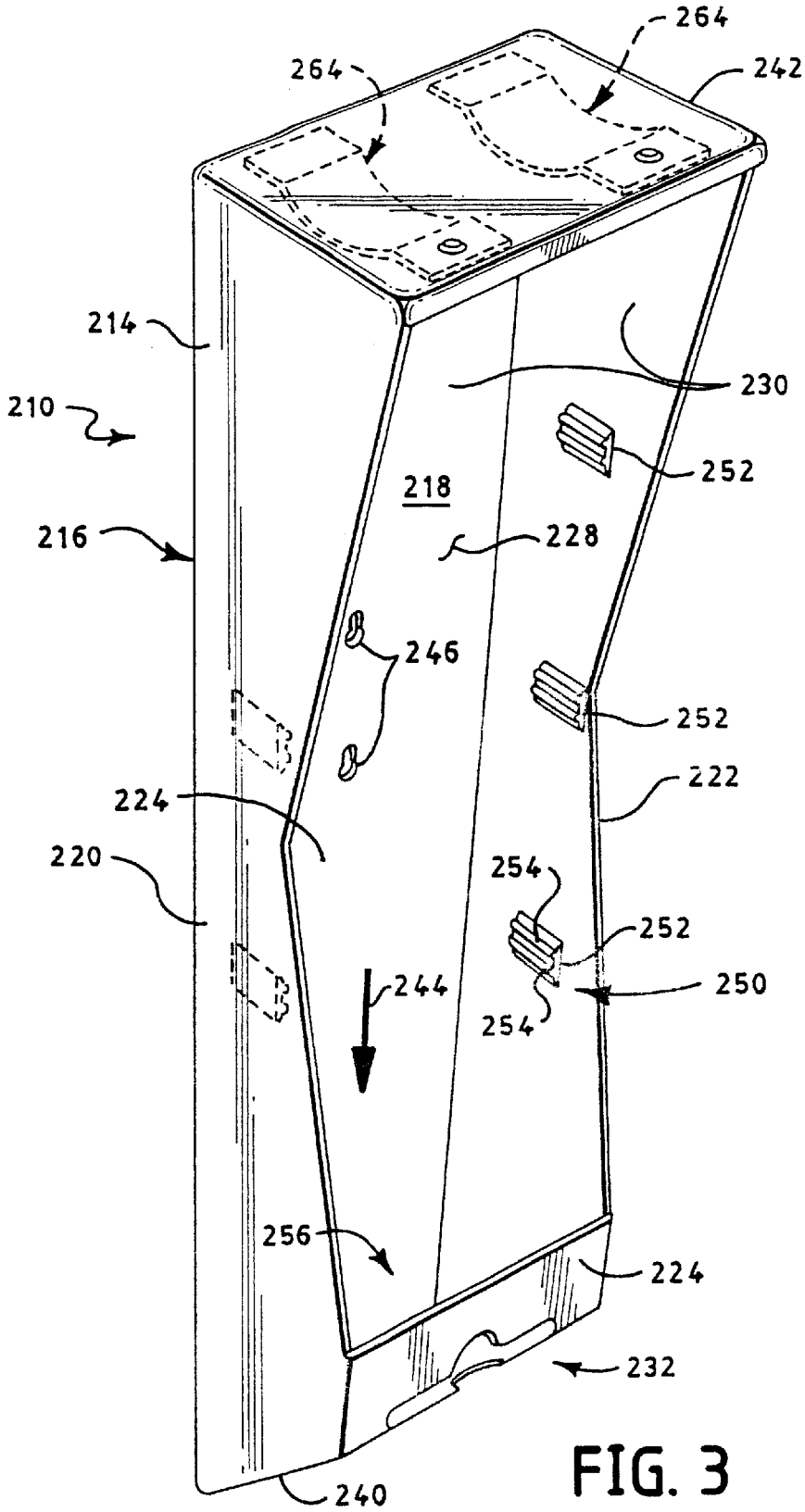
FIG. 3 is another exemplary container for dispensing paper products.

The container shown in FIG. 3 is generally similar to the one shown in FIG. 2. It can be seen that the housing depicted in FIG. 2 has a plurality of protrusions, including curved bumpers 252 which may include ridges, and rib members 258 located in a staging area 256.

An optional fourth wall 224 may be included in the container as shown in FIG. 3. The fourth wall 224 may partially cover the front of the housing and may function as a cartridge containing means. Although the fourth wall 224 is shown intersecting or contacting the first end wall 240, the fourth wall 224 may be separated from the first end wall and appear as a band or strip or wall connecting the second wall 220 and the third wall 222. Alternatively and/or additionally, the optional fourth wall 224 may have a fixed portion and a hinged portion that may function as a door. If an optional fourth wall 224 is used, a dispensing throat 232 may be provided at the intersection of the fourth wall 224 and the first end wall 240. In such an embodiment, paper products 212 are dispensed in a dispensing direction 244 through the dispensing throat 232. As shown in FIG. 3, the fourth wall 224 may be quite small and with the first end wall 240 form a dispensing throat 232 leaving a face of the container 210 substantially open. Further, housing 214 can also be constructed with double walls for security reasons.

The housing 214 may include an attachment portion for attaching the housing to a substantially nonhorizontal surface such as a vertical wall. As shown in FIG. 3, an attachment portion 246 may define holes through the first wall 218 of the housing 214 for receiving attachment members (not shown) such as screws, bolts, nails, etc. for attaching the housing to a wall. Alternately, a mounting bracket could be formed on an exterior surface of the first wall for contacting and being supported by another bracket, screws, bolts, nails, etc. extending from a wall. Further, the housing could be secured to a wall via a glue, epoxy, etc., or any other type of adhesive. Also, it would be possible to locate the attachment portion 246 on any part of the housing 214, such as the second wall 220, the third wall 222, the first end wall 240, or second end wall 242, and to use combinations of mounting devices on several of the above-identified parts of the housing. Further, the housing could simply be positioned such that first end wall 240 is lower than the second end wall 242, and so that the first end wall 240 and possibly the first wall 218 are supported in some way without fixing the housing 214 to any particular structure.

Thus, the means for urging paper products 212 in a dispensing direction 244 may comprise any structure or orientation, or both, of the housing 214 and/or wall it is mounted on that allows paper products 212 to be urged in dispensing direction 244 by gravity. Other types of mechanisms for urging paper products 212 the dispensing direction 244 such as, for example, spring loaded plates and the like are contemplated and may be especially useful if the container is mounted horizontally. For example, the container may project horizontally from a wall or may be placed on or mounted to a horizontal surface (e.g., on a countertop, table top or workbench).

In accordance with the invention, at least one protrusion, referred to generally as 250, extends from interior surface 230 on at least one of exterior walls 216 into interior area 228 of housing 214. Desirably, as shown in FIG. 3, second wall 220 and third wall 222 include protrusions 250 extending into interior area 228. Protrusions 250 preferably comprise curved bumpers 252, which may include a plurality of ridges 254 extending across the curved bumpers perpendicular to dispensing direction 244.

Bumpers 252 extend into interior area 228 to contact paper products 212 and thereby oppose the means for urging paper products 212 in dispensing direction 244. By extending into interior area 228 to contact paper products 212, bumpers 252 impede the movement of paper products 212 in the dispensing direction 244, but do not prohibit such movement. Ridges 254 allow numerous paper products 212 to be contacted by an individual bumper and allow for a smoother movement of paper products through housing 214. In embodiments where the means for urging paper products 212 in dispensing direction 244 includes mounting housing 214 so that gravity causes such movement, protrusions 250 also support paper products 212 against the force of gravity. Protrusions 250 therefore reduce the gravitational force of the bottom of the paper products 212, thereby making it easier for a user to remove individual paper products from the container.

Generally speaking, the exterior curve of bumper 252 may be defined by a radius of from about 1.125 to 1.750 inches. The bumper may have a chordal length of from about 1.625 to 1.875 inches. Individual ridges 254 may each have a radius of from about 0.125 to 0.250 inches, and their centers may each be spaced about 0.250 inches from the center of bumper 252. While the disclosed bumper shape is a desired shape, other shapes could be used.

In accordance with the invention, protrusions 250 on second wall 220 are desirably staggered from protrusions 250 on third wall 222 relative to dispensing direction 244. Such staggering provides a smooth movement of paper products 212 along dispensing direction 244. Paper products 212, being supported alternately on one side or the other by the staggered protrusions 250, "walk" down housing 214 in dispensing direction 244. Staggering protrusions 250 in dispensing direction 244 is important in embodiments where paper products 212 are moved in dispensing direction 244 due to the mounting or orientation of housing 214 by gravity. For example, if protrusions 250 were spaced opposite from each other on second wall 220 and third wall 222, paper products 212 might be entirely prevented from moving in dispensing direction and thus sit on top of a pair of protrusions 250. Also, paper products 212 might unevenly move in spurts past a pair of non-staggered protrusions 250 which could lead to misaligning of paper products and ultimately jamming of paper products within housing 214. Thus, staggering of protrusions 250 allows an orderly walking of paper products 212 along housing 124 in dispensing direction 244 where first one side of the paper products, and then the other, moves more steadily downward.

The container 210 includes a second group of protrusions 250 extending from first wall 218 into interior area 228 to contact paper products 212. The second group of protrusions 250 is preferably disposed in a staging area 256 near dispensing throat 232 for spacing, slowing, aligning and supporting paper products 212 as they are moved in dispensing direction 244. Preferably, members 258 extending parallel to dispensing direction 244 as shown in FIG. 2. Rib members 258 may have different dimensions to properly support and guide the paper products 212. For example, rib members 258 may have a sloping configuration and an optional radius of curvature.

Generally speaking, the rib members 258 may have a height ranging from about 0.5 to 2 inches at the location where it intersects with the first wall 218 and, in some embodiments, may even have an offset or height ranging from about 0.1 to about 0.5 inch where the rib member 258 is adjacent to or contacts the first end wall 240.

However, it should be understood that the dimensions of these rib members may be varied to accommodate a variety of factors including, but not limited to, the size of the paper product, basis weight of the paper product, composition/texture of the paper product, fold pattern of the paper product, height of the stack of paper products, force supplied by the means to urge the paper products to the dispensing throat, amount and dimensions of protrusions located on the second and third walls of the container as well as amount of other rib members positioned proximate the dispensing throat.

The housing 214 may be made of injection-molded plastic such as polyethylene or nylon. However, other suitable materials, such as other plastics or metals, may be provided for any or all of the parts of the housing 214. Curved bumpers 252 and rib members 258 are preferably formed integral with housing 214. However, curved bumpers 252 and rib members 258 may be formed separately from housing 214 and attached later. Also, curved bumpers 252 and rib members 258 may be made of different material from housing 214 if desired. For example, curved bumpers 252 and/or rib members 258 may be made of a more resilient material than the materials described above, such as an elastomer or rubber.

While curved bumpers 252 have been described as disposed on second and third walls 220 and 222, which are side walls in FIGS. 1 and 2, curved bumpers 252 could be disposed on any pair of opposite walls of the housing 214. Also, although rib member or members 258 have been described as disposed on the first wall 218, rib member or members 258 could be disposed on any wall or pair of opposite walls of housing.

Desirably, the paper products 212 are interfolded or tab interfolded to provide metered feeding of individual napkins one at a time. However, the present invention does not require the use of interfolded paper products.

The housing 214 may hold multiple clips of paper products 212 (if a cartridge is not used), and may extend from 30 to as much as 48 inches from end to end. Desirably, first wall 218 is angled between 0–5 degrees from the vertical to prevent paper products from falling out of the housing 214 during refilling.

Figure 4:
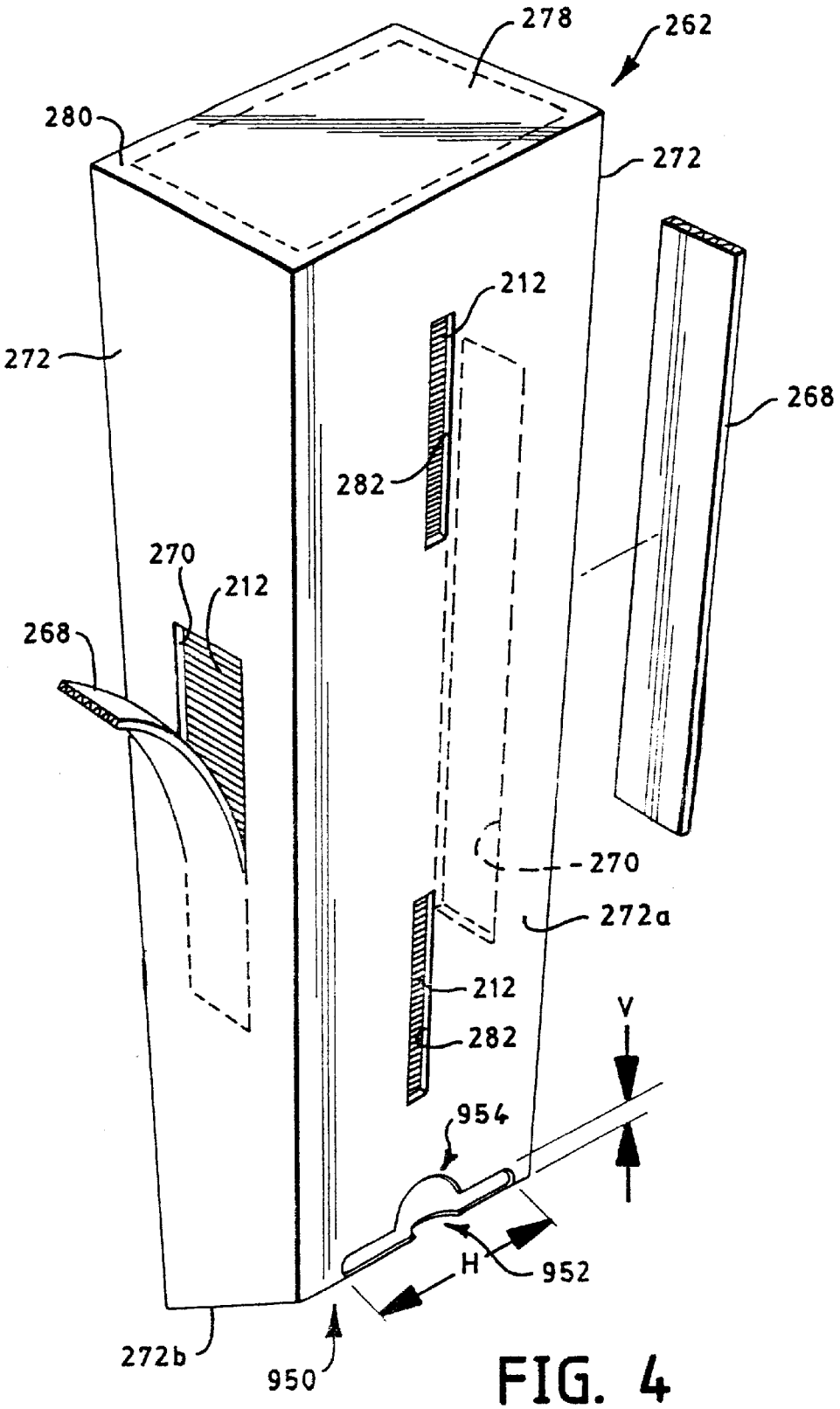
FIG. 4 is a perspective view of an exemplary cartridge which is configured for use with the exemplary containers of FIGS. 1–3.
Figure 6:
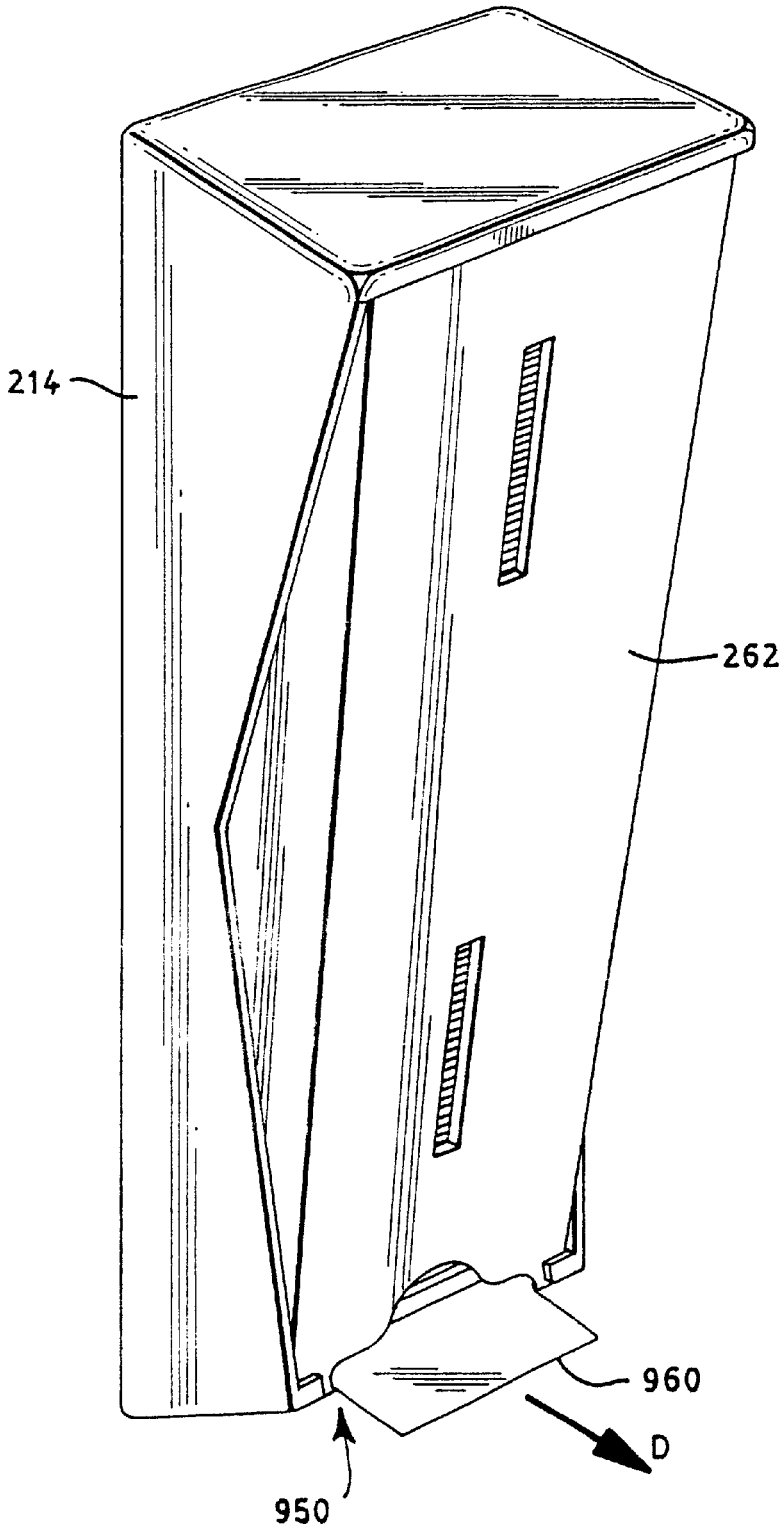
FIG. 6 is a perspective view of another exemplary embodiment showing an exemplary cartridge as depicted in FIG. 4 or 5 placed in an exemplary housing as shown in FIGS. 1–3.

Referring now to FIG. 4, there is shown a cartridge 262 which is adapted to be inserted into the interior area 228 of the housing 214 and which is further adapted for holding or containing paper products 212 to be dispensed. As illustrated in FIG. 6, the cartridge 262 is sized to fit snugly within the interior area 228 of the housing 214. If desired, leaf springs 264 (see FIG. 3) may be provided attached to the inside of the second end 242 of the housing 214 to hold the cartridge 262 in place. Any other suitable mechanism such as a tab or other interlock may be used to hold the cartridge 262 in the housing 214 is within the scope of the invention.

Referring again to FIG. 4, the cartridge 262 includes a plurality of removable portions 268, the removal of which creates openings 270 through the cartridge 262. Removable portions 268 are disposed in outside walls 272 of cartridge 262 so that, once removable portions 268 are removed, openings 270 encompass and receive protrusions 250 that may extend from the interior surface 230 of the housing 214. Thus, upon removal of removable portions 268 and placement of cartridge 262 in housing 214, curved bumpers 252 and rib members 258 contact the paper products 212 within cartridge.

Figure 5:
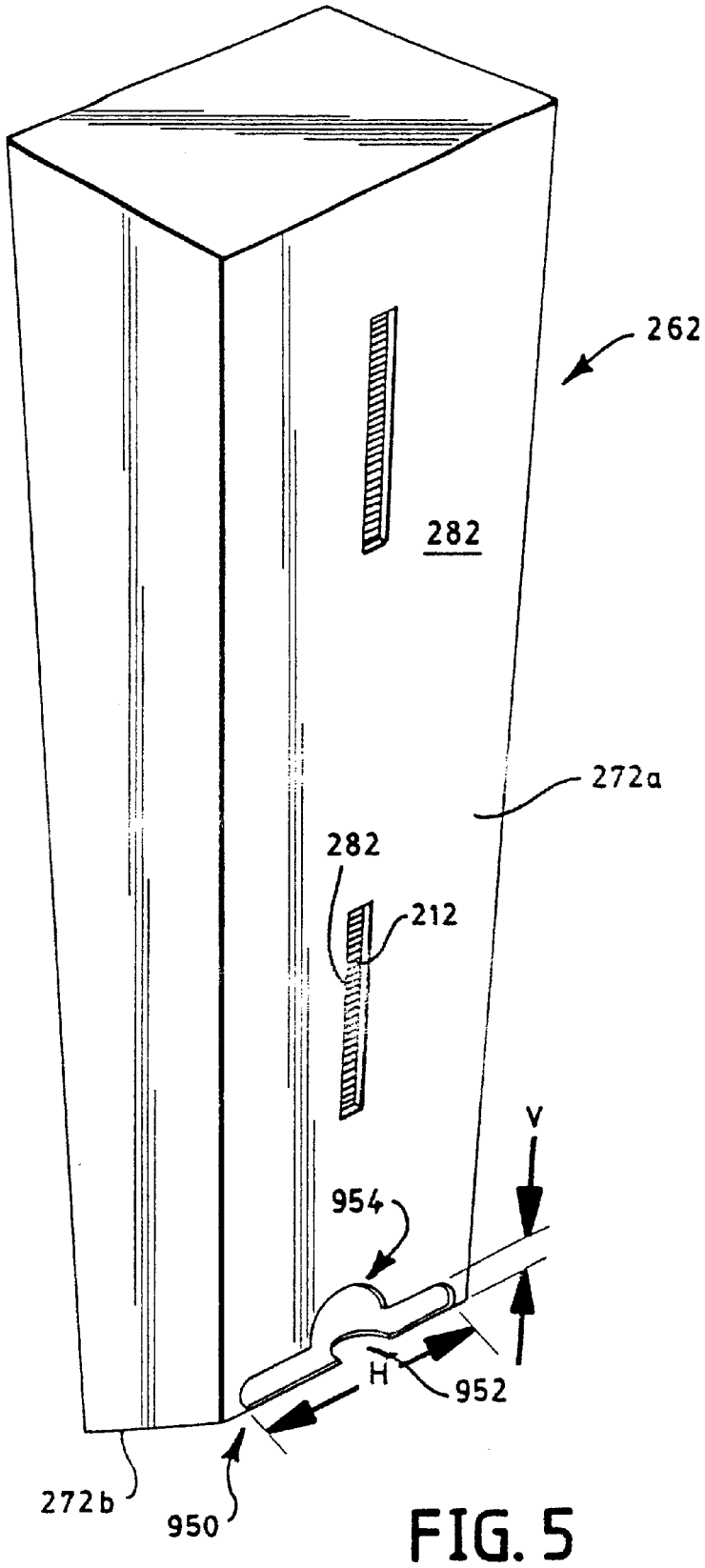
FIG. 5 is a perspective view of another exemplary cartridge which is configured for use with the exemplary containers of FIGS. 1 through 3.

FIG. 5 is a perspective of another exemplary cartridge 262. Generally speaking, the cartridge includes a cartridge body having cartridge walls and may further include removable sections defined in the cartridge body generally as described above. Since the container embodiments of FIGS. 1 and 2 described above may have an open face rather than a dispensing throat, a cartridge front wall 272*a* (illustrated in FIGS. 4 and 5) is intended to be positioned in the open face of the container should include a slit, slot, orifice or channel 950 that can serve to control access to the paper products 212 held within. Desirably, the slot is defined by the cartridge front wall 272*a* and the bottom wall 272*b* of the cartridge. However, it is contemplated that other locations may be used.

The slit is desirably sized so that it has a horizontal dimension "H" that is about the same or as slightly greater than the width of the paper products with the cartridge and a vertical dimension "V" that is large enough to permit the passage of a limited number of paper products. For example, if the paper products are in the form of folded paper napkins, the vertical dimension "V" of the slit may be sized so that a limited number of folded paper napkins may be extracted. This could be achieved by making the vertical dimension "V" some multiple of the thickness of an individual folded paper napkin (e.g., desirably greater than about two and less than about ten thicknesses, even more desirably greater than about two and less than about six thicknesses).

The paper product may be accessed by a thumb slot 952 and/or a finger slot 954. Desirably, these slots are located on the front and bottom faces of the cartridge and may be centered with respect to the dimensions of the cartridge or the dimensions of the slot.

The cartridge may define at least one additional slot 282 through one of the cartridge walls, the slot being visible from outside the housing when the cartridge is in the interior area of the housing, an amount of paper products disposed within the cartridge being determinable by visually inspecting the amount of paper products through the slot.

Cartridge 262 may also include another removable portion 278 disposed at end 280 of cartridge 262. Removable portion 278 may be removed to received a spring-loaded plate if cartridge 262 is to be used in a container with a spring-loaded plate or other means for urging the paper products in the dispensing direction.

Figure 7:
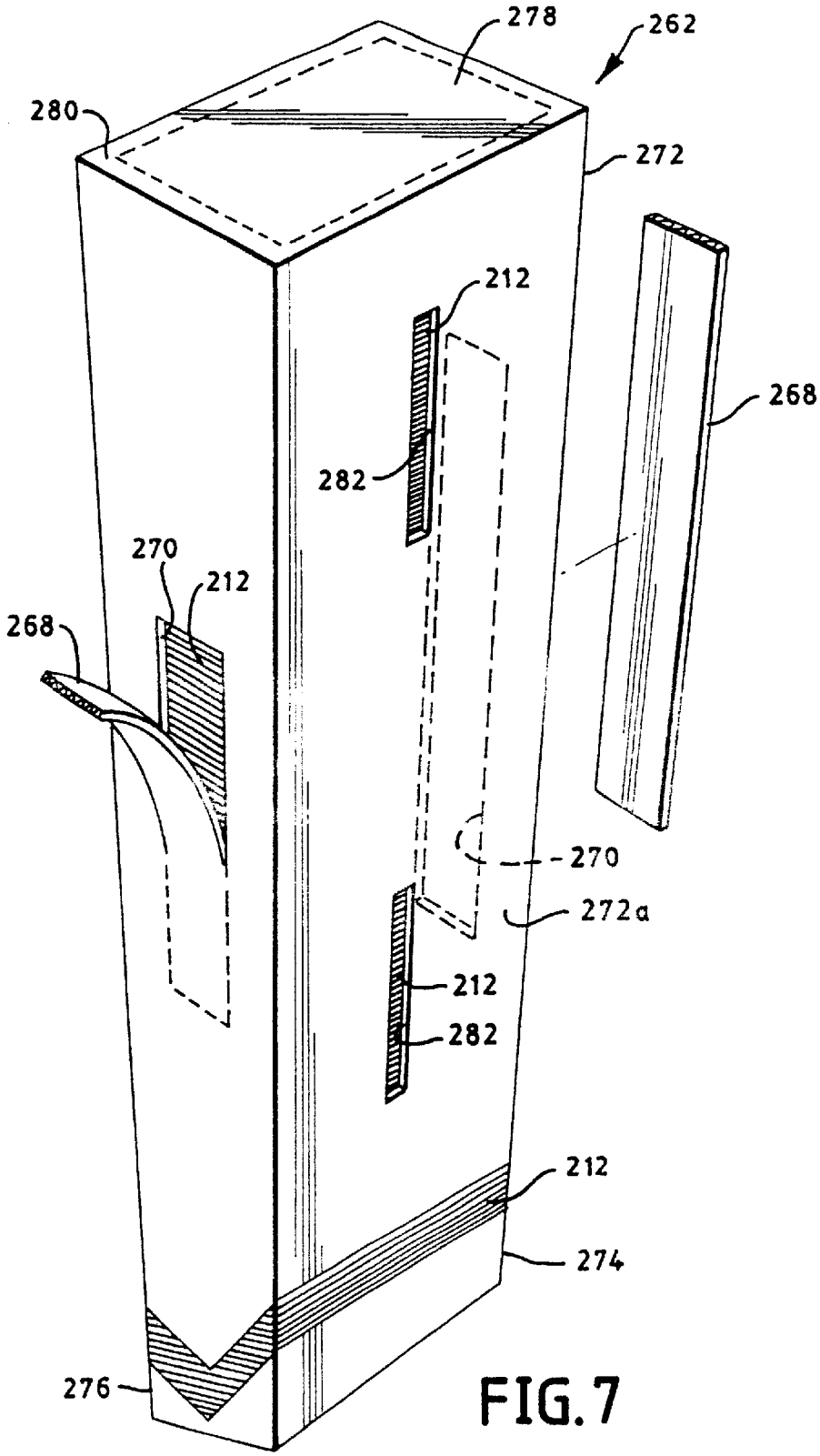
FIG. 7 is a perspective view of an exemplary cartridge which is configured for use with the exemplary container of FIG. 3.

As shown in FIG. 7, a removable portion 274 may be provided at end 276 of cartridge 262 for use in containers of the type shown in FIG. 3 so that paper products 212 can be supported and aligned by rib member 258 for dispensing through dispensing throat 232. Alternately, end 276 of cartridge 262 may be formed such that a plurality of smaller removable portions may be provided corresponding to rib members 258. It is also contemplated that a different smaller removable portion may be provided corresponding to the dispensing throat 232. If a separate removable portion corresponding to the dispensing throat 232 is provided, it is contemplated that it may be used with or without other removable portions corresponding to rib members and/or any other protrusions.

Generally speaking, removable portions 268, 278, and 274 may either be removed (or simply not formed) during manufacture of cartridge 262 or removed during installation of cartridge 262 in housing 214. If these removable portions are to be removed as part of the manufacturing process, cartridge 262 should be shipped to the user wrapped, for example in a polyethylene bag, to prevent contamination and/or to preserve the sterility of the paper products in the cartridge. If the removable portions are to be removed as part of the installation process, the edges of the removable portions should be weakened, scored, etc. for easy removal. It is desirable that removable portion 274 should not be removed as part of the manufacturing process to ensure that paper products 212 remain properly loaded in cartridge 262.

Optional removable portions 268 may be placed on front wall 272 (and/or a back wall which is not shown) of cartridge 262. Removable portions 268 may be used if optional protrusions 258 (i.e., rib members) are used on the first wall 218 of the housing 214 (see, for example, FIG. 2).

Preferably, cartridge 262 includes at least one slot 282 extending through one of the cartridge walls 272. Slot 282 is visible from outside the housing 214 when cartridge 262 is mounted in interior area 228. A user can visually determine the amount of paper products 212 remaining within cartridge 262 by inspecting the amount of paper products visible through slot 282. As shown in FIG. 7, two slots may be provided to provide a greater range of visual inspection. Any number or arrangement of slots is possible within the scope of the invention.

Cartridge 262 is preferably made of heavy paper or cardboard, but may be made of any other suitable material within the scope of the invention.

Referring again to FIG. 6, there is shown a perspective view of an exemplary cartridge as depicted in FIG. 4 placed in an exemplary housing as shown in FIG. 1 or 2. A dispensing direction "D" is identified as generally perpendicular to the housing and cartridge assembly. If the paper product is, for example, an interfolded paper napkin or tissue, a leading flap or tail 960 would extend out of the slot 950 and be available for a user to grasp.

Figure 8:
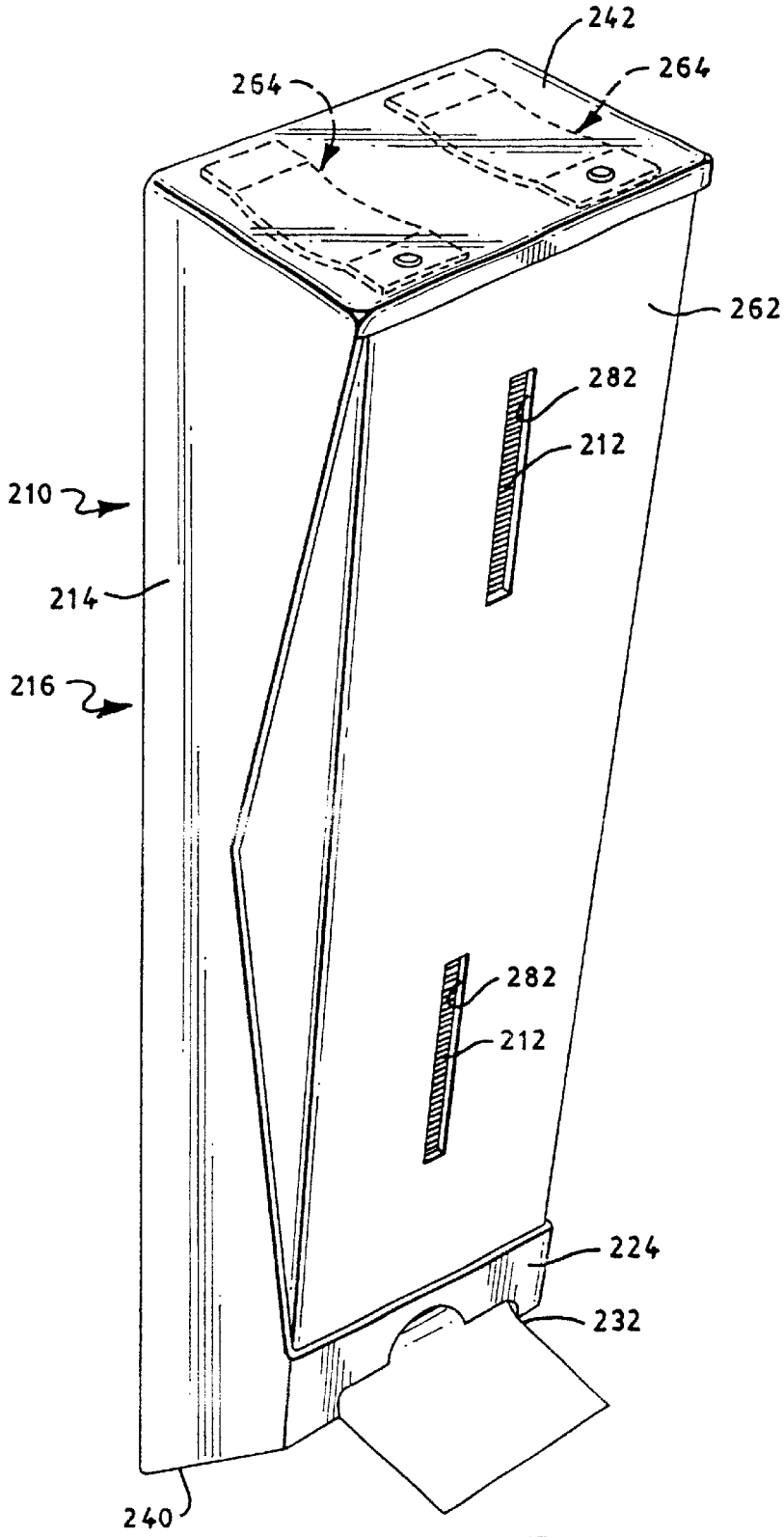
FIG. 8 is a perspective view of another exemplary embodiment showing an exemplary cartridge as depicted in FIG. 7 placed in an exemplary housing as shown in FIG. 3.

FIG. 8 is a perspective view of an exemplary cartridge 262 which may be of the type illustrated in FIG. 4, 5 or 7 placed into an exemplary housing which may be of the type shown in FIG. 3 that has a dispensing throat 232. A dispensing direction "D" is identified as generally perpendicular to the housing and cartridge assembly. If the paper product is, for example, an interfolded paper napkin or tissue, a leading flap or tail 960 would extend out of the dispensing throat 232 and be available for a user to grasp.

The dispensing throat 232 is desirably sized so that it has a horizontal dimension "H" that is about the same as or slightly greater than the width of the paper products within the cartridge and a vertical dimension "V" that is large enough to permit the passage of a limited number of paper products. Of course, the cartridge 262 will need to be configured to cooperate with the dispensing throat. Generally speaking, if the paper products are in the form of folded paper napkins, the vertical dimension "V" of the dispensing throat may be sized so that a limited number of folded paper napkins may be extracted. This could be achieved by making the vertical dimension "V" some multiple of the thickness of an individual folded paper napkin (e.g., desirably greater than about two and less than about six thicknesses).

The paper product may be accessed by a thumb slot and/or a finger slot. Desirably, these slots are located on the fourth wall 224 and the first end wall 240 and may be centered with respect to the dimensions of the housing or the dimensions of the dispensing throat 232.

Figure 9:
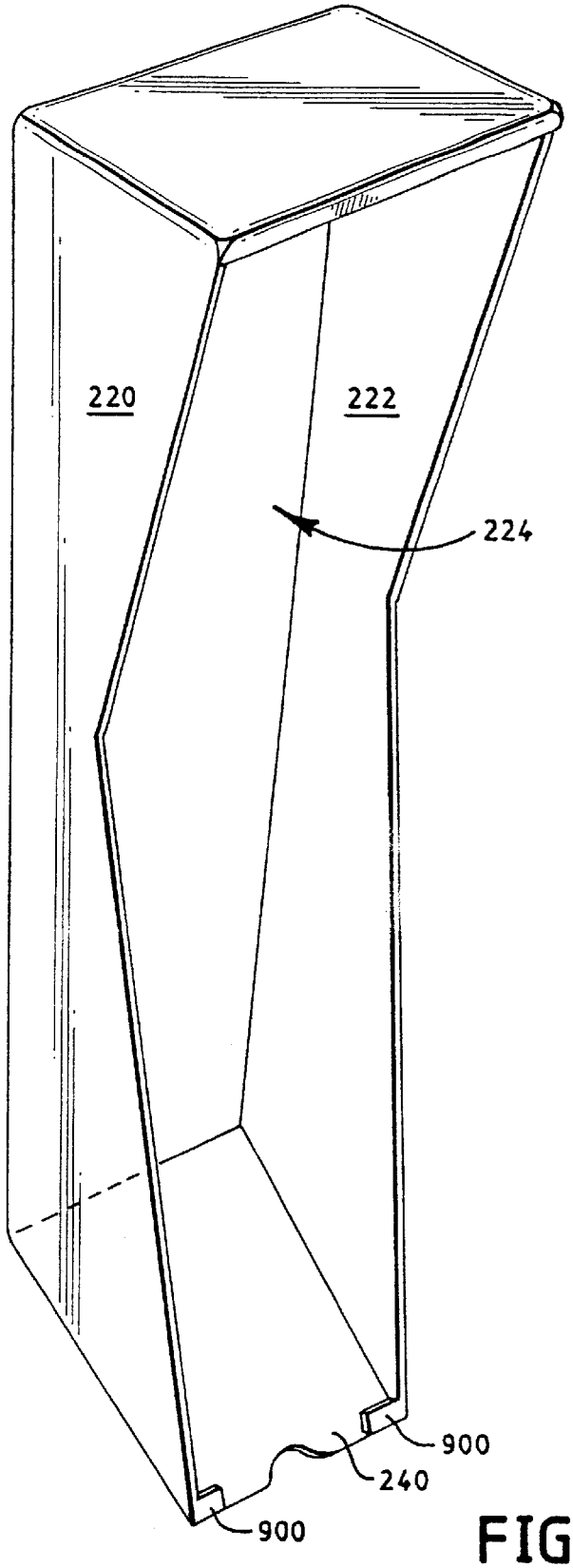
FIG. 9 is yet another embodiment of an exemplary housing.

FIG. 9 is yet another embodiment of an exemplary housing. This embodiment differs from the embodiments shown in FIGS. 1 and 2 in that the first end wall 240 of FIGS. 1 and 2 generally slopes away from the front or open face of the housing. In contrast, the first end wall 240 of FIG. 9 slopes into or opens up to the front or open face of the housing.

Figure 10:
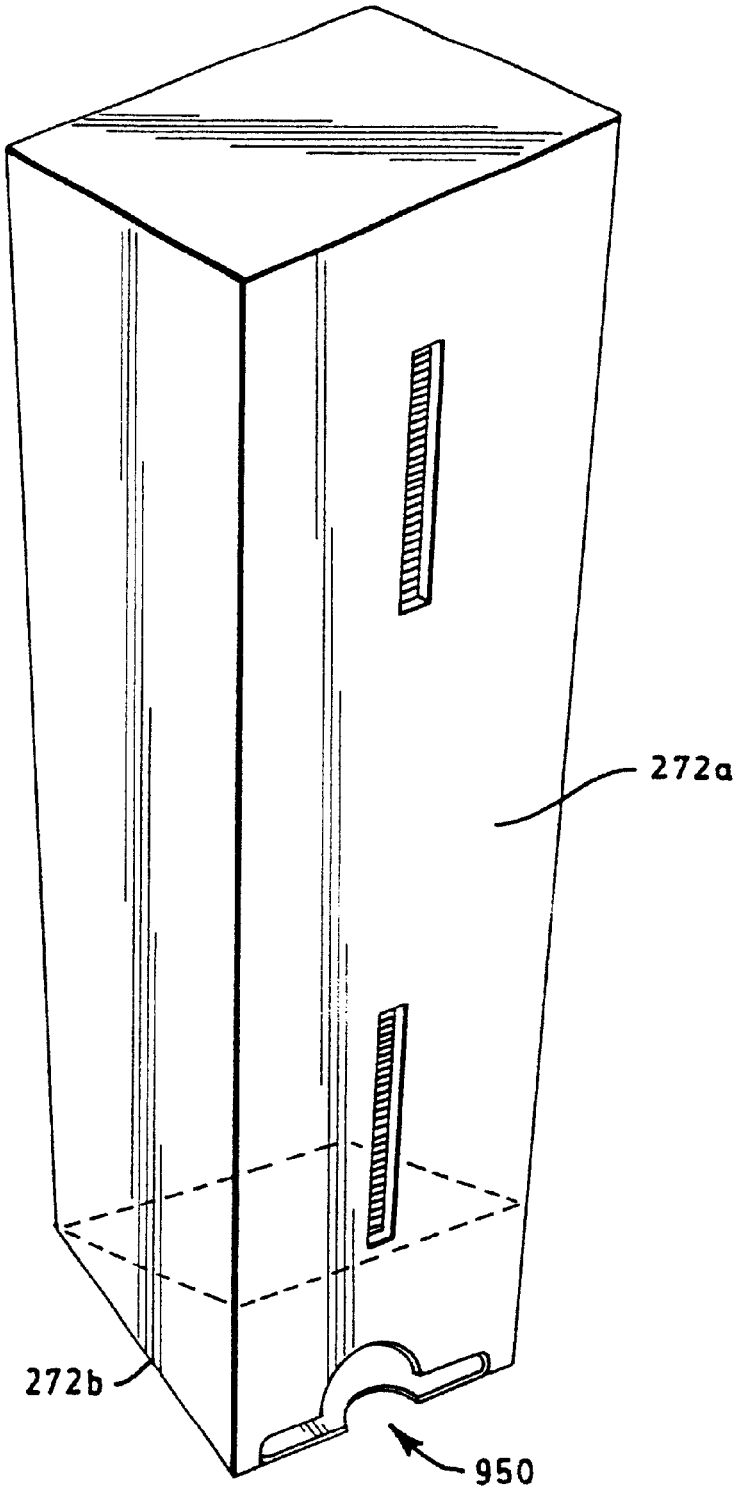
FIG. 10 is an exemplary cartridge which is intended to be inserted into the housing shown in FIG. 9.

FIG. 10 is an exemplary cartridge which is intended to be inserted into the housing shown in FIG. 9. The cartridge front wall 272*a* and the bottom wall 272*b* are configured to fit snugly in the housing.

Figure 11:
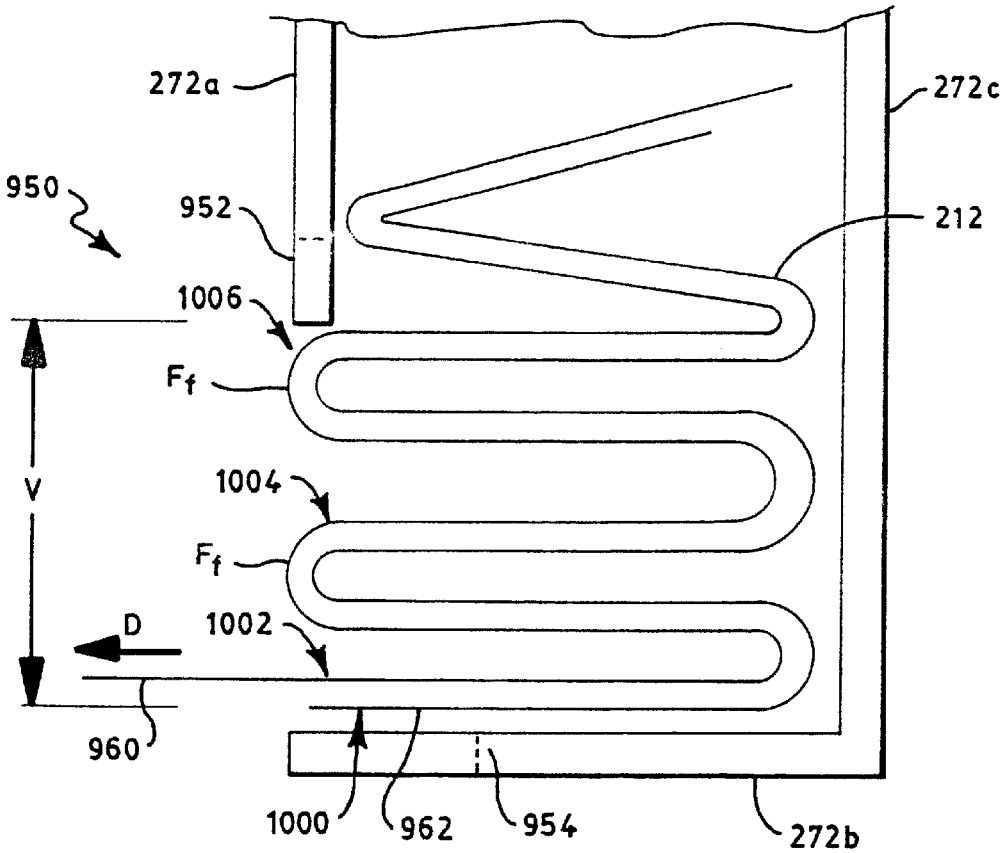
FIG. 11 is an enlarged cross-sectional view (not to scale) of the lower portion of the container and cartridge assembly shown in FIG. 6 or 8.

FIG. 11 is an enlarged cross-sectional view (not to scale) of the lower portion of the container and cartridge assembly shown in FIG. 6. The cartridge front wall 272*a*, a cartridge bottom wall 272*b* and cartridge back wall 272*c* and a stack of interfolded paper product 212 is shown. As can be seen in the enlarged and expanded view, the slot 950 has a vertical dimension "V" which is generally some multiple of the thickness of a single layer or ply or fold of the paper product 212. A dispensing direction "D" is identified as generally perpendicular to the housing and cartridge assembly. If the paper product is, for example, an interfolded paper napkin or tissue, a leading flap or tail 960 can be seen extending out of the slot 950 for a user to grasp. Pulling the leading flap 960 will result in a one-at-a-time dispensing of the product.

It should be understood that FIG. 11 may also generally represent an enlarged cross-sectional view (not to scale) of the lower portion of the container and cartridge assembly shown in FIG. 8. The cartridge front wall 272*a* may be read as corresponding to the fourth wall 224, the bottom wall 272*b* corresponding to the first end wall 240, the back wall 272*c* corresponding to the first wall 218, the slot 950 corresponding to the dispensing throat 232, and the finger and thumb slots in the cartridge corresponding to finger and thumb slots in the fourth wall 224 and the first end wall 240. Of course, the cartridge may be configured as shown in FIGS. 4, 5 and/or 7 to cooperate with the dispensing throat. Thus, the following description applies to embodiments of the invention having a generally open face (i.e., lacking a dispensing throat in the housing) as well as embodiments with a dispensing throat.

Gripping the interfolded product between lower grip point 1000 and a first upper grip point 1002 engages two of the interfolded paper products (e.g., napkins, tissues, wipes, etc.) for dispensing. One of which has a visible tail 960 extending from the slot 950 (or dispensing throat 232) and the other still located inside the cartridge but accessible through the finger slot 954. Pulling the product engaged at grip points 1000 and 1002 in the dispensing direction "D" will result in two of the interfolded paper products to be dispensed at a time. This result will be consistent provided the interfolding of the product is consistent with the grip areas 1000 and 1002 remain accessible.

Pulling the product engaged at grip points 1000 and 1004 in the dispensing direction "D" will result in four of the interfolded paper products to be dispensed at a time. The result will be consistent provided the interfolding of the product is consistent and the grip areas 1000 and 1004 remain accessible.

Pulling the product engaged at grip points 1000 and 1006 in the dispensing direction "D" will result in six of the interfolded paper products to be dispensed at a time. This result will be consistent and the grip areas 1000 and 1006 remains accessible. This can be described mathematically for interfolded products as $N-F_f \times 2$ where N= the number of products dispensed, $F_f$= the number of forward folds ($F_f$) falling between the identified grip points and which are gripped by the user. The number of forward folds ($F_f$) available for gripping is generally limited only by the vertical dimension of the slot "V" and the size of the finger slots. Generally speaking, the "stack" of product dispensed will be in a folded configuration except for the leading and trailing edge or flap. Of course, if the product is dispensed one-at-a-time, it will be in a unfolded configuration.

If a non-interfolded product is used in the cartridge, the dispensing direction "D" remains the same. However, there will be no leading flap as in the interfolded format. Generally speaking, the number of products dispensed will be the same as the number of forward folds gripped unless the product is double or triple folded. Thus, it can be seen how the container and cartridge may be used to dispense a controlled amount of paper products.

It will be apparent to those skilled in the art that various modifications and variations can be made in the present invention without departing from the scope and spirit of the invention. It is intended that the present invention include such modifications and variations as come within the scope of the appended claims and their equivalents.

We claim:

1. A container for dispensing a controlled amount of paper products, the container comprising:

a housing including a first end wall and a plurality of exterior walls defining an interior surface and an interior area within the interior surface for receiving the plurality of paper products, a first, second and third of the exterior walls intersecting a first end wall to form a portion of the interior surface and define an open face of the container, a fourth wall extending between the second and third walls adjacent the first end wall and the open face, the fourth wall and the first end wall defining a dispensing throat;

protrusions extending from the interior surface into the interior area for contacting the paper products; and a cartridge for insertion into the interior area of the housing, the cartridge containing the plurality of paper products to be dispensed, the cartridge including cartridge walls including a front wall disposed in the open face of the container when the cartridge is disposed within the housing, openings being defined in the cartridge walls wherein at least one of the protrusions extends through at least one of the openings to contact the plurality of paper products, a slit being defined through the front wall for dispensing the plurality of paper products.

2. The container of claim 1, further including cartridge retaining means for retaining the cartridge in the interior area of the housing.

3. The container of claim 2, wherein the cartridge retaining means is configured on opposing second and third walls.

4. The container of claim 2, wherein the cartridge retaining means is configured on the first end wall.

5. The container of claim 1, wherein the housing further includes at least one element selected from blocks, chucks, stops, wires, braces, brackets, bars, pins, clips, hooks, clamps, adhesive materials, and interlocking container and cartridge geometries, the at least one element retaining the cartridge within the housing.

6. The container of claim 1, wherein the dispensing throat is adjacent the slit in the cartridge.

7. The container of claim 6, wherein the dispensing throat includes a finger slot in the fourth wall.

8. The container of claim 6, wherein the dispensing throat includes a thumb slot in the first end wall.

9. The container of claim 1, the housing further comprising a staging area proximate the first end wall for spacing and slowing the paper products.

10. The container of claim 1, wherein the cartridge walls include a bottom wall, the slit being defined by the front wall and the bottom wall of the cartridge.

11. The container of claim 10, wherein the cartridge is configured so the slit includes a finger slot in the front wall and a thumb slot in the bottom wall.

12. The container of claim 1, wherein the cartridge is configured so the slit is sized to have a horizontal dimension about the same as or slightly greater than the width of the paper products within the cartridge and a vertical dimension that is large enough to permit the passage of a limited number of paper products.

13. The container of claim 12, wherein the cartridge is configured so the vertical dimension of the slit is between about 2 and about 10 times the thickness of an individual folded paper product.

14. The container of claim 1, wherein the housing further includes a bar connecting the second and third exterior walls, the bar retaining the cartridge within the housing.

15. The container of claim 14, wherein the bar defines a dispensing throat having a finger slot.

16. The container of claim 1, further comprising means for urging the paper products within the interior area in a dispensing direction toward the first end wall to a dispensing position near the slit.

17. The container of claim 16, wherein the protrusions extending from the portion of the interior surface on the exterior walls oppose the means for urging.

18. The container of claim 1, wherein the first end wall is slanted relative to the second and third walls, and the cartridge includes a bottom wall configured to conform to the slanted first end wall of the housing.

19. The container of claim 18, wherein the first end wall slants downward in the direction of the open face of the container.

20. The container of claim 18, wherein the first end wall slants upward in the direction of the open face of the container.

21. The container of claim 1, wherein the protrusions include rib members extending from the first end wall of the housing and the cartridge includes openings at locations corresponding to the rib members.

22. The container of claim 1, wherein the protrusions include bumpers extending from the second and third walls, and the cartridge includes openings at locations corresponding to the bumpers.

23. A container for dispensing a controlled amount of paper products, the container comprising:

a housing including a first end wall and a plurality of exterior walls defining an interior surface and an interior area within the interior surface for receiving the plurality of paper products, a first, second and third of the exterior walls intersecting a first end wall to form a portion of the interior surface and define an open face of the container, the exterior walls further including a fourth wall extending between the second and third walls adjacent the first end wall and the open face, the container defining a dispensing throat extending through the fourth wall, the first end wall being slanted relative to the second and third walls;

protrusions extending from the interior surface into the interior area for contacting the paper products; and a cartridge for insertion into the interior area of the housing, the cartridge containing the plurality of paper products to be dispensed, the cartridge including cartridge walls including a front wall disposed in the open face of the container when the cartridge is disposed within the housing, openings being defined in the cartridge walls wherein at least one of the protrusions extends through at least one of the openings to contact the plurality of paper products, a slit being defined through the front wall adjacent the dispensing throat in the housing for dispensing the plurality of paper products through the dispensing throat.

24. The container of claim 23, wherein the first end wall slants downward in the direction of the open face of the container.

25. The container of claim 23, wherein the first end wall slants upward in the direction of the open face of the container.

26. The container of claim 23, wherein the cartridge is configured so the slit is sized to have a horizontal dimension about the same as or slightly greater than the width of the paper products within the cartridge and a vertical dimension that is large enough to permit the passage of a limited number of paper products.

27. The container of claim 26, wherein the cartridge is configured so the vertical dimension of the slit is between about 2 and about 10 times the thickness of an individual folded paper product.

28. A container for dispensing a controlled amount of paper products, the container comprising:

a housing including a first end wall and a plurality of exterior walls defining an interior surface and an interior area within the interior surface for receiving the plurality of paper products, a first, second and third of the exterior walls intersecting a first end wall to form a portion of the interior surface and define an open face of the container, the exterior walls further including a fourth wall extending between the second and third walls adjacent the first end wall and the open face, the container defining a dispensing throat extending through the fourth wall, the first end wall being slanted relative to the second and third walls; and a cartridge for insertion into the interior area of the housing through the open face of the container, the cartridge containing the plurality of paper products to be dispensed, the cartridge including cartridge walls including side walls, a front wall disposed in the open face of the container, and a bottom wall being slanted relative to the side walls so as to be matingly disposed against the first end wall of the container when the cartridge is disposed within the housing, a slit being defined through the front wall adjacent the dispensing throat in the housing for dispensing the plurality of paper products though the dispensing throat.

29. The container of claim 28, wherein the cartridge is configured so the vertical dimension of the slit is between about 2 and about 10 times the thickness of an individual folded paper product.

30. The container of claim 29, wherein the slit includes finger and thumb slots.

31. The container of claim 30, wherein the dispensing throat includes finger and thumb slots.

32. The container of claim 28, wherein the first end wall slants downward in the direction of the open face of the container.

33. The container of claim 28, wherein the first end wall slants upward in the direction of the open face of the container.

34. The container of claim 28, further including cartridge retaining means for retaining the cartridge in the interior area of the housing.

35. The container of claim 28, further including protrusions extending from the interior surface into the interior area for contacting the paper products, openings being defined in the cartridge walls wherein at least one of the protrusions extends through at least one of the openings to contact the plurality of paper products.

36. The container of claims 35, wherein the protrusions include rib members extending from the first end wall of the housing and the cartridge includes openings at locations corresponding to the rib members.

37. The container of claim 35, wherein the protrusions include bumpers extending from the second and third walls, and the cartridge includes openings at locations corresponding to the bumpers.

* * * * *